United States Patent [19]

Siegel

[11] 4,281,771

[45] Aug. 4, 1981

[54] CHILD-RESISTANT/NON-CHILD-RESISTANT CLOSURE

[76] Inventor: Craig S. Siegel, 88 Bear Mountain Rd., Ringwood, N.J. 07456

[21] Appl. No.: 157,534

[22] Filed: Jun. 9, 1980

[51] Int. Cl.[3] ..... B65D 55/02; B65D 85/56; A61J 1/00

[52] U.S. Cl. ..... 215/220; 215/215

[58] Field of Search ..... 215/215, 219, 220, 221

[56] References Cited

U.S. PATENT DOCUMENTS

| | | | |
|---|---|---|---|
| 3,138,277 | 6/1964 | Milbourne | 215/215 |
| 3,520,435 | 7/1970 | McIntosh | 215/220 |
| 3,857,505 | 12/1974 | Mumford et al. | 215/220 |

*Primary Examiner*—George T. Hall

[57] ABSTRACT

A child-resistant/non-child-resistant dual function double cap closure with incorporated means for over-ride of conventional normally disengaged torque couplings includes a hole formed in the top surface of the outer cap, a formed plug having a locking protuberance and removal ring, and a plurality of spaced stop lugs formed annularly on the top surface of the inner cap. The free and separate movement of the outer cap is prevented in either direction of rotation by the plug's insertion into the hole of the outer cap as to place the base of the plug in the space between the stop lugs of the inner cap rendering the cap non-child-resistant at the time of consumer purchase. The consumer may use the cap in a non-child-resistant mode or remove the plug thus converting the cap to a child-resistant mode.

8 Claims, 5 Drawing Figures

CHILD-RESISTANT/NON-CHILD-RESISTANT CLOSURE

BACKGROUND OF THE INVENTION

The present invention relates to child-resistant container closures and more particularly to child-resistant closures that are comprised of an inner cap that actually seals the container, and an outer overcap that by means of various torque coupling mechanisms does not allow the inner cap to be rotated in a counter-clockwise direction without combined downward pressure and torque or side compression and torque as exemplified in closures set forth in U.S. Pat Nos. 3,795,337, 3,795,338 3,857,505 3,944,102 4,069,935, 4,165,813.

The increased use of child-resistant closures on containers of pharmaceuticals, detergents and cleansers, automotive antifreeze and household chemcials of all types has done much to prevent the accidental poisoning and chemical burning of children. But in doing so, it has also caused hardship and inconvenience for persons who are afflicted with arthritis, missing digits or hands, blindness or similar afflictions since many child-resistant closures are difficult if not impossible to open by persons with such afflictions. Another problem is the difficulty of opening containers, especially by elderly persons, when the closures are screwed on very tight. The double-cap child-resistant closure has become an inconvenience for those persons who do not have children living with them, and a hardship for those who have difficulty operating the closures. Furthermore, there appears to be growing consumer resistance to purchase products packaged with container closures which experience has shown are inherently difficult to operate.

SUMMARY OF THE INVENTION

One of the principal objects of the present invention is to provide a mechanism of few and simple parts to override the one way normally disengaged torque coupling mechanisms of child-resistant double cap closures to provide a container closure that at the time it is manufactured and distributed is non-child-resistant but can be easily converted to child-resistant at the discretion and need of the consumer. Another object is to provide a mechanism of the type stated that lends to the present state of the art the manufacturing of a single closure to be child-resistant or non-child-resistant and is easily incorporated into present molding, forming and capping equipment. These and other objects and advantages will become apparent hereinafter.

The present invention embodied in a child-resistant container closure includes a formed hole positioned in the top surface of the outer cap, a formed plug for insertion in said hold and equipped with a locking protuberance on its upper portion and a removal ring as part of its top portion, and a plurality of molded or formed lugs which protrude upwards from the top surface of the inner cap and are positioned in the same radial arc as the hole in the outer cap and positioned toward the center of any other conventional torque mechanisms. The invention also consists in the parts and in the arrangement and combination of parts hereinafter described and claimed.

DESCRIPTION OF THE PREFERRED EMBODIMENT

Figure 3:
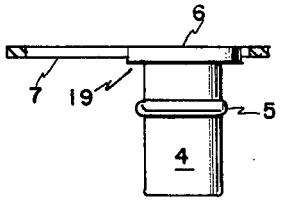
FIG. 3 is a side elevational view of the locking plug depicted in FIG. 1 and FIG. 2.
Figure 4:
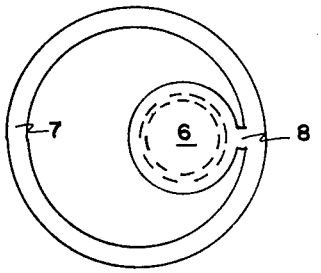
FIG. 4 is a top plain view of the plug as shown in FIG. 3.
Figure 5:
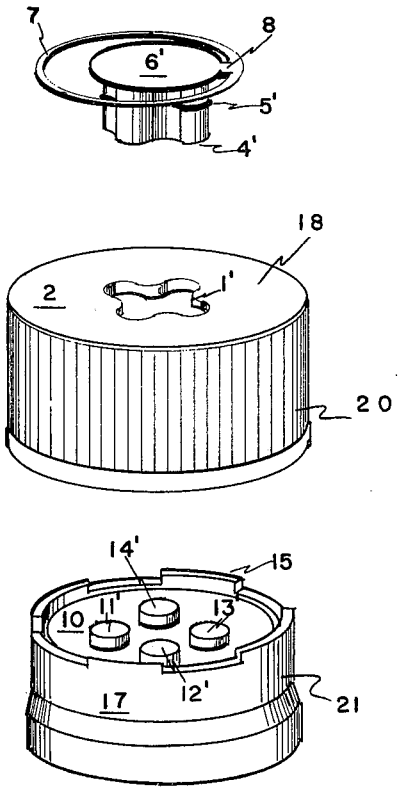
FIG. 5 is an exploded perspective view of a slightly modified embodiment of the plug, outer cap, and inner cap as is shown in FIG. 1.

A preferred embodiment of the invention is shown in the drawings and comprises an outer cap member generally designated 2 with a top panel 18, a plug generally designated 4 in FIGS. 1 through 4, and 4' in FIG. 5, and an inner cap member generally designated 17 and having a circular top panel designated 10.

Figure 1:
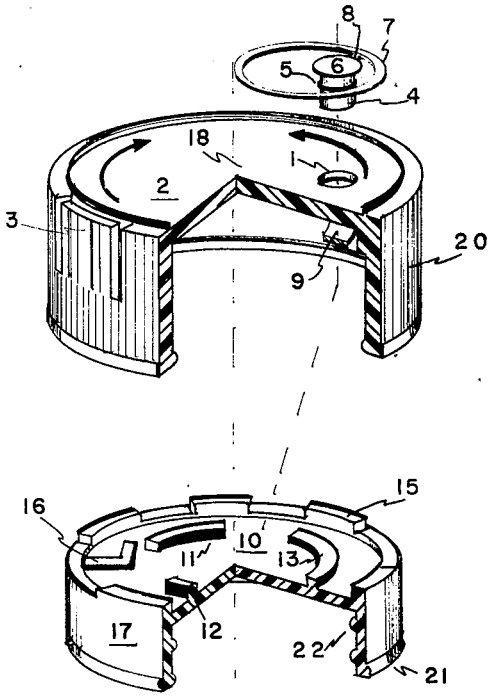
FIG. 1 is an exploded, partially cut away, perspective view of the present invention embodied in a screw-on child-resistant double cap closure.

The outer cap member 2, as shown in FIG. 1, is formed with a circular top panel 18 integrally molded with depending sidewalls 20. Molded through the top surface 18 of outer cap 2 is a formed hole 1, as shown in FIG. 1, and 1' as shown in FIG. 5, positioned centrally of any other conventional torque coupling mechanism components such as leaf spring 9 that are an integral part of the underside of said top surface 18. Hole 1 and 1' are of sufficient size and shape to accomodate plug 4 and 4' respectively.

Figure 2:
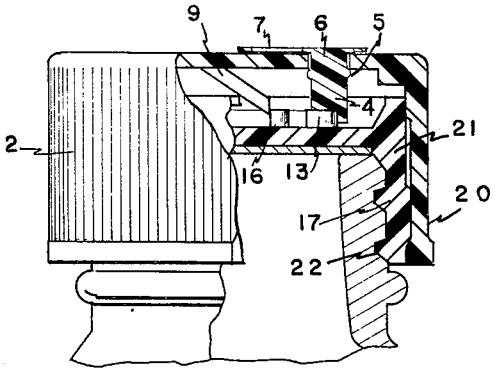
FIG. 2 is a partially cut away side elevational view of the present invention embodied in a screw-on child-resistant double cap closure.

For the insertion into hole 1 is a formed plug 4 as shown in FIG. 3. The plug is of sufficient length to pass through hole 1 and extend to the upper surface 10 of inner cap 17 when the inner and outer caps are assembled as shown in FIG. 2. A locking protuberance 5 is integrally molded on the body of the plug with the vertical center of said protuberance at a distance from the underside of the plug top 6 slightly greater than the dimensional thickness of the circular top panel 18 of outer cap 2 and with an annular lateral projection sufficient to secure the plug in top panel 18 with a downward pressure snap fit. The accidental removal or falling out of the plug is prevented by an interference of the underside edge of hole 1 in the top panel 18 and the upper surface of protuberance 5 as shown in FIG. 2. Plug top 6, as shown in FIGS. 3 and 4 is of a larger diameter than the plug body to provide a definite bearing surface 19 against top panel 18. Plug 4 is held in a tight and rigid vertical alignment through hole 1 of the outer cap top panel 18 by constant pressure exerted by said bearing surface 19 against top panel 18 and the upper surface of protuberance 5 against top panel 18. As an integrally molded part of plug top 6 and removal ring 7 is a flexible and resilient tab 8. In addition to providing a functional interconnection between removal ring 7 and plug 4, tab 8 transmits the upward force created when a person pulls on the free side of the removal ring 7 to the plug body thus providing the mechanism for removing plug 4 from hole 1.

The functional parts of plug 4' and the interrelationship and interaction with outer cap 2 as shown in FIG. 5 are the same as described above, although the hole and plug shape and position of same are slightly modified to facilitate manufacturing and may provide greater torque transmission from outer cap 2 to inner cap 17 as will be described later.

With respect to FIGS. 1 and 5, the inner cap 17 is moded as an integral unit having a circular top panel 10 and integrally molded depending sidewalls 21. The interior of the sidewalls 21 are provide with a female thread 22 for engagement with a male thread finish on conventional containers. Projecting vertically from the top surface 10 are a plurality of integrally molded conventional drive lugs 15 forming a crown configuration. Immediately positioned centrally to the crown 15 is a plurality of conventional ratchet drive lugs 16 integrally molded on the top surface 10. Centrally located of any conventional torque coupling mechanisms and projecting vertically up from the top panel 10 are a plurality of integrally molded stop lugs 11, 12 and 13 in FIG. 1, and 11' through 14' in FIG. 5. It should be noted that the plurality of stop lugs in FIG. 1 is to facilitate manufacturing assembly since only one space between any two stop lugs is needed for the present invention to function. Stop lugs 11, 12, and 13 in FIG. 1 and 11' through 14' in FIG. 5, are located in the same radial arc as hole 1 and 1' in outer cap 2 respectively.

The outer cap member 2, inner cap member 17, and plug 4 may be manufactured of any sufficiently resilient thermoplastic or other suitable material.

The interrelationship and interaction of the parts becomes evident to one skilled in the art when viewing FIG. 2. Plug 4 is positioned and held fast in hole 1 of the top panel 18 of outer cap 2 to place the base of plug 4 in the space between any two stop lugs such as between stop lugs 11 and 13 thereby overriding any other incorporated conventional torque coupling mechanisms. Separate rotation of the inner cap 17 and other cap 2 is prevented since any torque movement of the outer cap 2 engages the base of plug 4 with a stop lug of inner cap 17. Thus the inner cap 17 and other cap 2 will drive as a unit and the resulting closure is non-child-resistant and may be removed from the container by a simple counter-clockwise axial rotation. Removing plug 4 from hole 1 by grasping the free side of removal ring 7 and pulling upward while applying downward pressure on outer cap 2 disengages the inner cap 17 and other cap 2 and renders any conventional normally disengaged torque couplings such as leaf spring and drive lug combinations or side pressure tabs 3 and drive lug combinations functional thereby converting the closure to child-resistant.

It can be seen by one skilled in the art that the positioning of the base of plug 4' in the spatial configuration formed by stop lugs 11' through 14' as shown in FIG. 5 and its removal will achieve the same result as described above as would other modified plug and stop lug configuratons.

Since there is no need for additional manipulation other than simple torque in the tightening proceedure, the assembled closure can be applied to containers with conventional capping machinery. Furthermore, products packaged in containers using the described closure would have greater marketability since the closure offers the consumer a choice of operational modes. The consumer may; (1) use the closure intact as non-child-resistant; (2) remove plug 4 thereby converting the closure to child-resistant; or (3) replace plug 4 just to facilitate opening the closure.

It is to be understood that all matter herein described or shown in the accompanying drawings is to be interpreted as illustrative and not in a limiting sense.

I claim:

1. A child-resistant/non-child-resistant closure for containers having an exterior male threaded portion comprising, in combination: An inner cap member having the interior of its depending sidewalls formed with female threads adapted to be threaded onto said container portion, with an integrally formed circular top panel having a plurality of spaced-apart stop lugs projecting vertically upward; an outer cap member with depending sidewalls and an integrally formed top panel embodying a formed hole superimposed in the same radial arc as said plurality of spaced-apart stop lugs, said outer cap loosely encompassing said inner cap; an integrally formed plug for insertion into said hole of the outer cap member to place the base of said plug in space between said stop lugs of the inner cap member, to engage said stop lugs to drive said inner and outer cap members as a unit when torque is applied in either direction of rotation to the other cap member rendering the closure non-child-resistant; said plug for removal from said hole in the outer cap member disengaging the inner and outer cap members to allow the outer cap member free and separate rotation rendering the closure child-resistant.

2. A closure as set forth in claim 1, wherein said closure may operate as either child-resistant or non-child-resistant.

3. The closure of claim 1, wherein said hole is formed to accept said plug.

4. The closure of claim 1, wherein said hole is centrally located of any other torque coupling mechanisms.

5. The closure of claim 1, wherein said plug is formed of a plastic material.

6. The closure of claim 1, wherein said plug is provided with an integrally formed locking protuberance and top.

7. The closure of claim 6, further including an integrally formed tab and removal ring on said top.

8. The closure of claim 1, wherein said plug is held in a tight and rigid vertical alignment through said hole in outer cap member by constant pressure exerted by plug top and locking protuberance.

* * * * *